US007621718B1

(12) United States Patent
Liang

(10) Patent No.: US 7,621,718 B1
(45) Date of Patent: Nov. 24, 2009

(54) TURBINE VANE WITH LEADING EDGE FILLET REGION IMPINGEMENT COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 499 days.

(21) Appl. No.: 11/729,109

(22) Filed: Mar. 28, 2007

(51) Int. Cl.
*F01D 25/12* (2006.01)

(52) U.S. Cl. ..... 415/115; 416/97 R

(58) Field of Classification Search ..... 415/115, 415/116, 96 R, 97 R
See application file for complete search history.

(56) References Cited

U.S. PATENT DOCUMENTS

| | | | | |
|---|---|---|---|---|
| 4,017,213 | A | 4/1977 | Przirembel | |
| 5,340,278 | A | 8/1994 | Magowan | |
| 5,382,135 | A | 1/1995 | Green | |
| 5,634,766 | A | 6/1997 | Cunha et al. | |
| 6,190,128 | B1 | 2/2001 | Fukuno et al. | |
| 6,341,939 | B1 | 1/2002 | Lee | |
| 6,398,486 | B1 | 6/2002 | Storey et al. | |
| 6,589,010 | B2 | 7/2003 | Itzel et al. | |
| 6,830,432 | B1 | 12/2004 | Scott et al. | |
| 7,097,417 | B2 | 8/2006 | Liang | |
| 7,220,103 | B2 * | 5/2007 | Cunha et al. | 416/97 R |
| 2006/0127220 | A1 * | 6/2006 | Lee | 416/97 R |

* cited by examiner

*Primary Examiner*—Edward Look
*Assistant Examiner*—Dwayne J White
(74) *Attorney, Agent, or Firm*—John Ryznic

(57) ABSTRACT

A turbine vane for use in a gas turbine engine, the vane including an airfoil portion and a endwall in which fillets extend around the airfoil at the junction to the endwall. A leading edge outer fillet surface is located over an inner fillet surface and forms an impingement cavity between the leading edge fillet surfaces. Metering and impingement cooling holes discharge impingement cooling air to the backside of the outer fillet surface, and film cooling holes of the outer fillet surface provide film cooling to the outer fillet surface. The outer fillet surface forms slots on the ends of both the pressure side and suction side to discharge cooling air along the fillets formed between the airfoil walls and the endwall. An internal partition separates the fillet impingement cavity into a pressure side cavity and a suction side cavity. Cooling air flows through the metering and impingement holes to provide backside cooling of the outer fillet surface, then flows out the film cooling holes and the slots to provide film cooling of the outer fillet surface and to direct cooling air along the fillets between the airfoil walls and the endwall.

16 Claims, 6 Drawing Sheets

TURBINE VANE WITH LEADING EDGE FILLET REGION IMPINGEMENT COOLING

BACKGROUND OF THE INVENTION

1. Field of the Invention

The present invention relates generally to fluid reaction surfaces, and more specifically to turbine vanes and the cooling of the leading edge fillet region.

2. Description of the Related Art Including Information Disclosed Under 37 CFR 1.97 and 1.98

In a typical combustion turbine engine, a variety of vortex flows are generated around airfoil elements within the turbine. FIG. 1 is a perspective view of a cut-away of several turbine airfoil portions 1 showing hot combustion fluid flow 3 around the airfoil portions 1. It is known that "horseshoe" vortices, including a pressure side vortex 4, and a suction side vortex 5, are formed when a hot combustion fluid flow 3 collides with the leading edges 6 of the airfoil portions 1. The vortices 4, 5 are formed according to the particular geometry of the airfoil portions 1, and the spacing between the airfoil portions 1 mounted on the platform 2. As the hot combustion fluid flow 3 splits into the pressure side vortex 4 and a suction side vortex 5, the vortices 4, 5 rotate in directions that sweep downward from the respective side of the airfoil portion 1 to the platform 2. On the pressure side 8 of the airfoil portions 1, the pressure side vortex 4 is the predominant vortex, sweeping downward as the pressure side vortex 4 passes by the airfoil portion 1. As shown, the pressure side vortex 4 crosses from the pressure side 8 of the airfoil portion 1 to the suction side 7 of an adjacent airfoil portion 1. In addition, the pressure side vortex 4 increases in strength and size as it crosses from the pressure side 8 to the suction side 7. Upon reaching the suction side 7, the pressure side vortex 4 is substantially stronger than the suction side vortex 5 and is spinning in a rotational direction opposite from the suction side vortex 5. On the suction side 7, the pressure side vortex 4 sweeps up from the platform 2 towards the airfoil portion 1. Consequently, because the pressure side vortex 4 is substantially stronger that the suction side vortex 5, the resultant, or combined flow of the two vortices 4, 5 along the suction side 7 is radially directed to sweep up from the platform 2 towards the airfoil portion 1.

A conventional approach to cooling fluid guide members, such as airfoils in combustion turbines, is to provide cooling fluid, such as high pressure cooling air from the intermediate or last stages of the turbine compressor, to a series of internal flow passages within the airfoil. In this manner, the mass flow of the cooling fluid moving through passages within the airfoil portion provides backside convective cooling to the material exposed to the hot combustion gas. In another cooling technique, film cooling of the exterior of the airfoil can be accomplished by providing a multitude of cooling holes in the airfoil portion to allow cooling fluid to pass from the interior of the airfoil to the exterior surface. The cooling fluid exiting the holes forms a cooling film, thereby insulating the airfoil from the hot combustion gas. While such techniques appear to be effective in cooling the airfoil region, little cooling is provided to the fillet region where the airfoil is joined to a mounting endwall. In a rotor blade, the flow forming surface extending on the sides of the airfoil and root is referred to as a platform. In a stator vane, an inner shroud and an outer shroud that forms the flow surfaces are referred to a endwalls.

The fillet region is important in controlling stresses where the airfoil is joined to the endwall. Although larger fillets can lower stresses at the joint, such as disclosed in U.S. Pat. No. 6,190,128, issued to Fukuno et al on Feb. 29, 2001 and entitled COOLED MOVING BLADE FOR GAS TURBINE the resulting larger mass of material is more difficult to cool through indirect means. Accordingly, prohibitively large amounts of cooling flow may need to be applied to the region of the fillet to provide sufficient cooling. If more cooling flow for film cooling is provided to the airfoil in an attempt to cool the fillet region, a disproportionate amount of cooling fluid may be diverted from the compressor system, reducing the efficiency of the engine and adversely affecting emissions. While forming holes in the fillet to provide film cooling directly to the fillet region would improve cooling in this region, it is not feasible to form holes in the fillet because of the resulting stress concentration that would be created in this highly stressed area.

Backside impingement cooling of the fillet region has been proposed in U.S. Pat. No. 6,398,486. However, this requires additional complexity, such as an impingement plate mounted within the airfoil portion. In addition, the airfoil portion walls in the fillet region are generally thicker, which greatly reduces the effectiveness of backside impingement cooling.

U.S. Pat. No. 6,830,432 B1 issued to Scott et al on Dec. 14, 2004 entitled COOLING OF COMBUSTION TURBINE AIRFOIL FILLETS discloses a row of fillet cooling holes positioned along the airfoil surface just above the fillet extending along the pressure side wall of the airfoil to direct a cooling film over the fillet. FIGS. 4 and 5 show the cooling flows for the Scott et al patent. The Scott et al patent does not disclose any cooling of the fillet in the leading edge region.

As the hot flow core gas enters the turbine with a boundary layer thickness and collides with the leading edge of the vane, the horseshoe vortex separates into a pressure side and suction side downward vortices. Initially, the pressure vortex sweeps downward and flows along the airfoil pressure side forward fillet region first. Then, due to hot flow channel pressure gradient from pressure side to suction side, the pressure side vortex migrates across the hot flow passage and end up at the suction side of the adjacent airfoil. As the pressure side vortex roll across the hot flow channel, the size and strength of the passage vortex becomes larger and stronger. Since the passage vortex is much stronger than the suction side vortex, the suction side vortex flow along the airfoil suction side fillet and acting as a counter vortex for the passage vortex. FIG. 1 shows the vortices formation for a boundary layer entering a turbine airfoil. As a result of these vortices flow phenomena, some of the hot core gas flow from the upper airfoil span is transferred toward close proximity to the end wall and thus creates a high heat transfer coefficient and high gas temperature region at the airfoil fillet region.

As shown in FIG. 1, the resulting forces drive the stagnated flow that occurs along the airfoil leading edge towards the region of lower pressure at the intersection of the airfoil and end wall. This secondary flow flows around the airfoil leading edge fillet and end wall region. This secondary flow then rolls away from the airfoil leading edge and flows upstream along the end wall against the hot core gas flow as seen in FIG. 2. As a result, the stagnated flow forces acting on the hot core gas and radial transfer of hot core gas will flow from the upper airfoil span toward close proximity to the end wall and thus creates a high heat transfer coefficient and high gas temperature region at the intersection location.

Currently, injection of film cooling air at discrete locations along the horseshoe vortex region is used to provide the cooling for this region. However, there are many drawbacks for this type of film blowing injection cooling method. The high film effectiveness level is difficult to establish and maintain in the high turbulent environment and high pressure variation such as horseshoe vortex region. Film cooling is very sensitive to the pressure gradient. The mainstream pressure variation is very high at the horseshoe vortex location. The spacing between the discrete film cooling holes and areas immediately downstream of the spacing are exposed less or provide no film cooling air. Consequently, these areas are more susceptible to thermal degradation and over temperature. As a result of this, spalling of the TBC and cracking of the airfoil substrate will occur.

For the airfoil pressure side fillet region, cooling of the fillet region by means of conventional backside impingement cooling yields inefficient results due to the thickness of the airfoil fillet region. Drilling film cooling holes at the airfoil fillet to provide film cooling produces unacceptable stress by the film cooling holes. An alternative way of cooling the fillet region is by the injection of film cooling air at discrete locations along the airfoil peripheral and end wall into the vortex flow to create a film cooling layer for the fillet region. The film layer migration onto the airfoil fillet region is highly dependent on the secondary flow pressure gradient. For the airfoil pressure side and suction side downstream section, this film injection method provides a viable cooling approach. However, for the fillet region immediately downstream of the airfoil leading edge, where the mainstream or secondary pressure gradient is in the stream-wise direction, injection of film cooling air from the airfoil or end wall surface will not be able to migrate the cooling flow to the fillet region to create a film sub-boundary layer for cooling that particular section of the fillet.

Accordingly, there is a need for improved cooling in the fillet regions of turbine guide members.

It is an object of the present invention to provide for impingement cooling and film cooling of the leading edge fillet region of a turbine vane.

BRIEF SUMMARY OF THE INVENTION

The present invention is a turbine vane with a fillet region formed between the airfoil leading edge and the inner and outer endwalls, the fillets also extending along the sides of the airfoil on the pressure and suction sides. The present invention includes the original fillet on the leading edge with the addition of an outer surface of louvers to form an impingement cavity between the original fillet surface and the louver. Metering and impingement cooling holes in the original fillet discharge cooling air into the cavity to provide backside cooling for the fillet, and second film cooling holes in the louver spaced around the leading edge provide additional film cooling for the leading edge fillets. The downstream sides of the louver on the pressure and suction sides of the fillets includes slots in which the impingement cooling air is discharged in the direction of the hot gas flow along the fillets on the airfoil sides.

The louver style film cooling slot is formed around the airfoil leading edge and end wall junction region. The louver is built on top of the regular airfoil leading edge fillet. In this particular construction approach, it retains the original design intend load path for the airfoil. A partition is used to compartment the louver into two louver film cooling slots to minimize the pressure gradient effect on film cooling flow distribution.

DETAILED DESCRIPTION OF THE INVENTION

Figure 1:
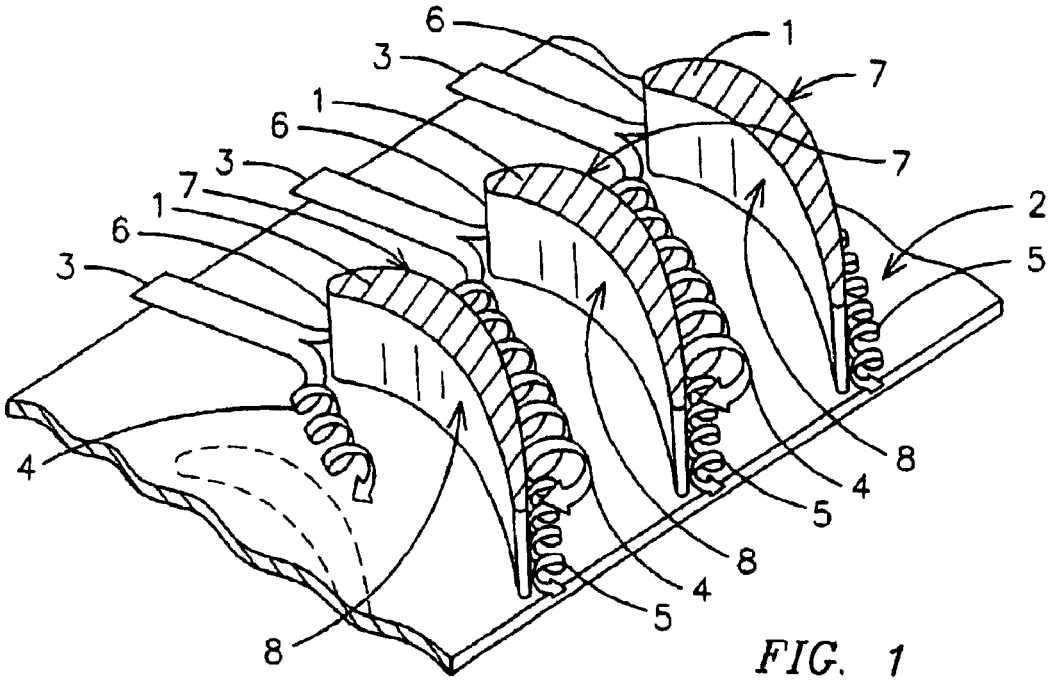
FIG. 1 PRIOR ART
FIG. 1 shows a schematic view of a prior art turbine vane hot gas flow with a vortex flow formation.
Figure 2:
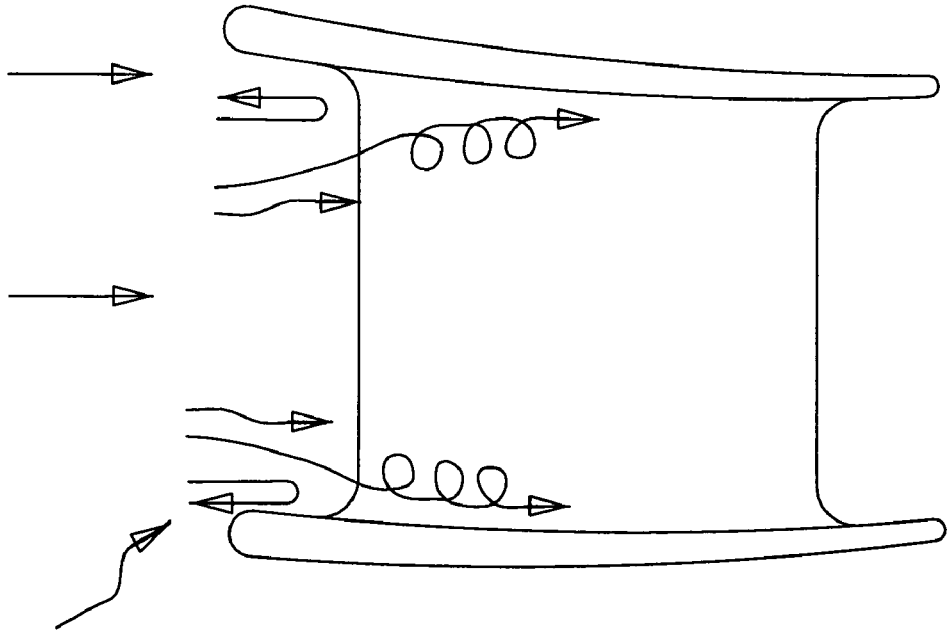
Fig 2 Prior Art
FIG. 2 shows a side view of the secondary flow direction of the hot gas flow of the prior art FIG. 1 turbine vane.
Figure 3:
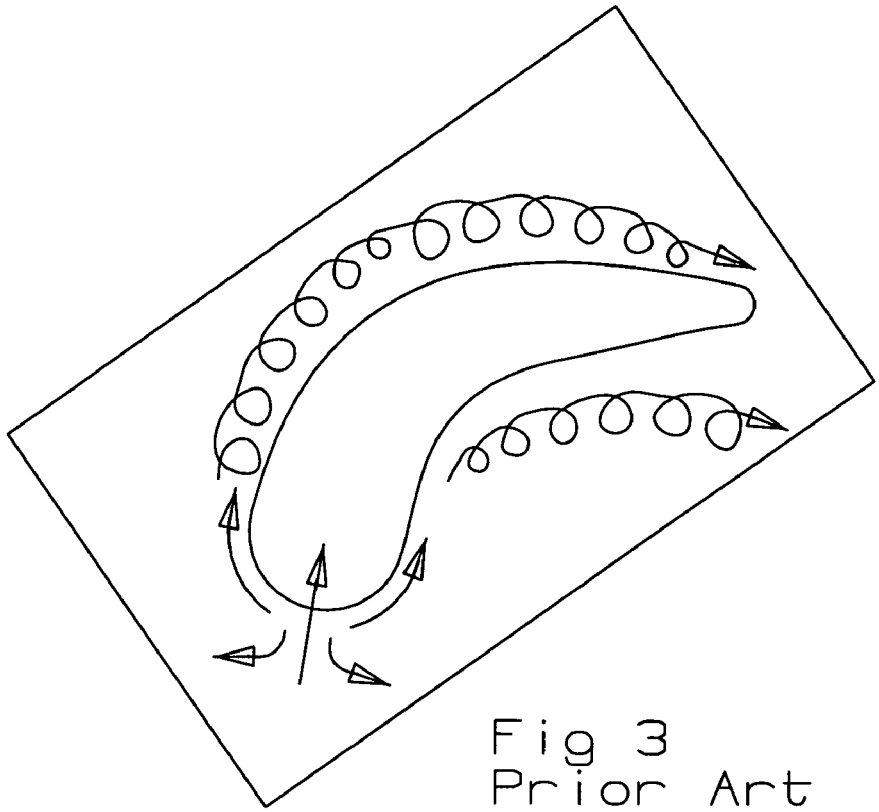
Fig 3 Prior Art
FIG. 3 shows a top view of the secondary flow direction of the hot gas flow of the prior art FIG. 1 turbine vane.
Figure 4:
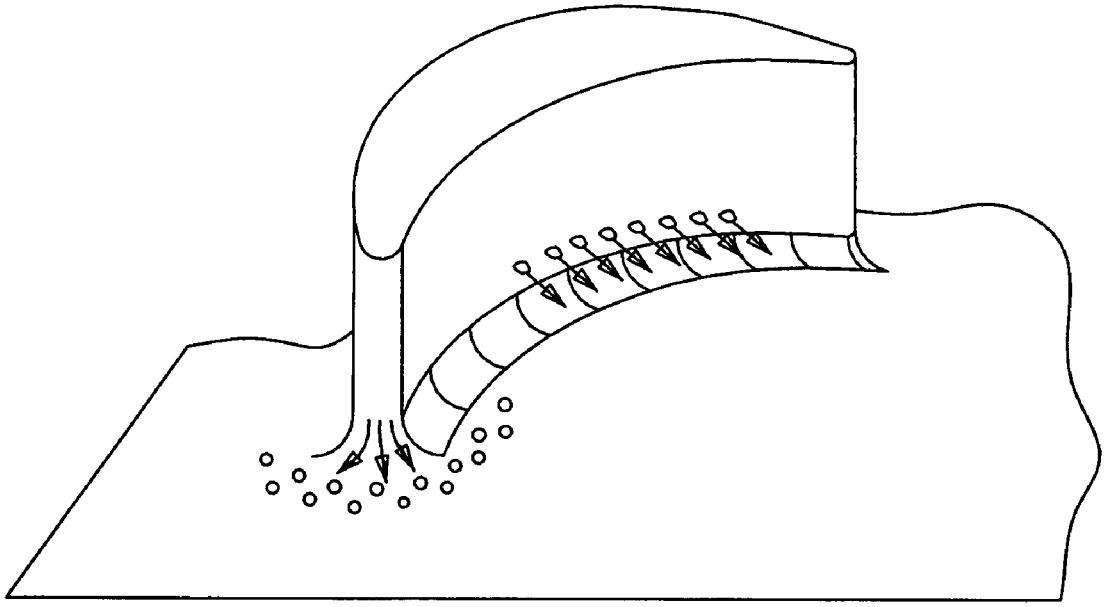
Fig 4 Prior Art
FIG. 4 shows a turbine vane of the prior art with pressure side and suction side fillet region cooling holes.
Figure 5:
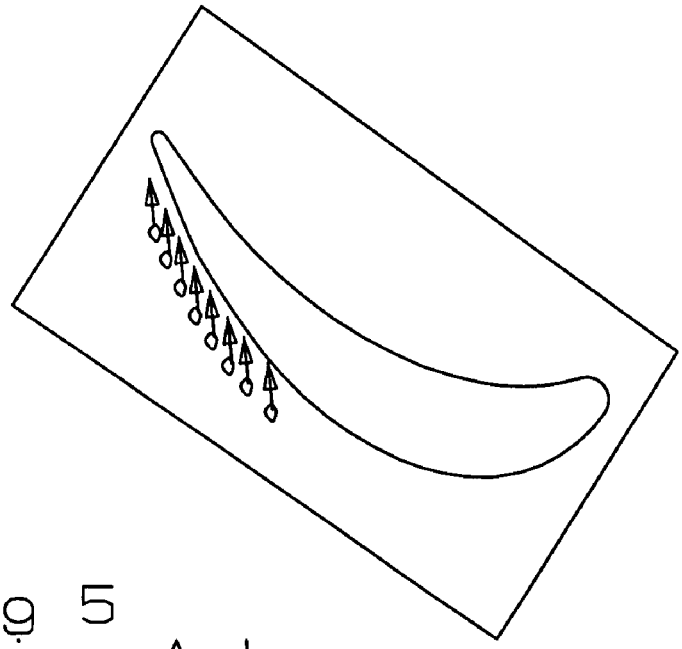
Fig 5 Prior Art
FIG. 5 shows a turbine vane of the prior art with suction side film cooling holes on the end wall.

A turbine vane for used in a gas turbine engine which is exposed to a very high temperature gas flow requires cooling in order for the vane to withstand the high temperature and to increase the efficiency of the engine. FIG. 1 shows a turbine vane with the fillet region cooling circuit of the present invention. The vane 11 includes cooling cavities 12 and 13 to channel cooling air from the compressor for use in cooling the vane. The blade includes the airfoil extending between an outer endwall 15 and an inner endwall 16. The airfoil includes the leading edge and the trailing edge. Fillets are formed between the airfoil junctions with the endwalls to reduce stress.

The vane includes the normal fillets on the upper and lower spans of the vane at the outer endwall 15 and the inner endwall 16 on the leading edge. A cooling hole 21 is formed in the airfoil wall for the lower fillet, and a cooling hole 22 is formed in the airfoil wall for the upper fillet. The invention includes an outer surface forming a louver 23 on the lower fillet and 24 on the upper fillet. The lower louver 23 includes leading edge film cooling holes 27 and the upper louver includes leading edge film cooling holes 28. Between the louver and the original fillet surfaces is formed a leading edge fillet impingement cavity 20. An upper film cooling hole 25 discharges cooling air toward the upper louver 24, while a lower leading edge film cooling hole 26 discharges cooling air toward the lower louver 23.

Figure 6:
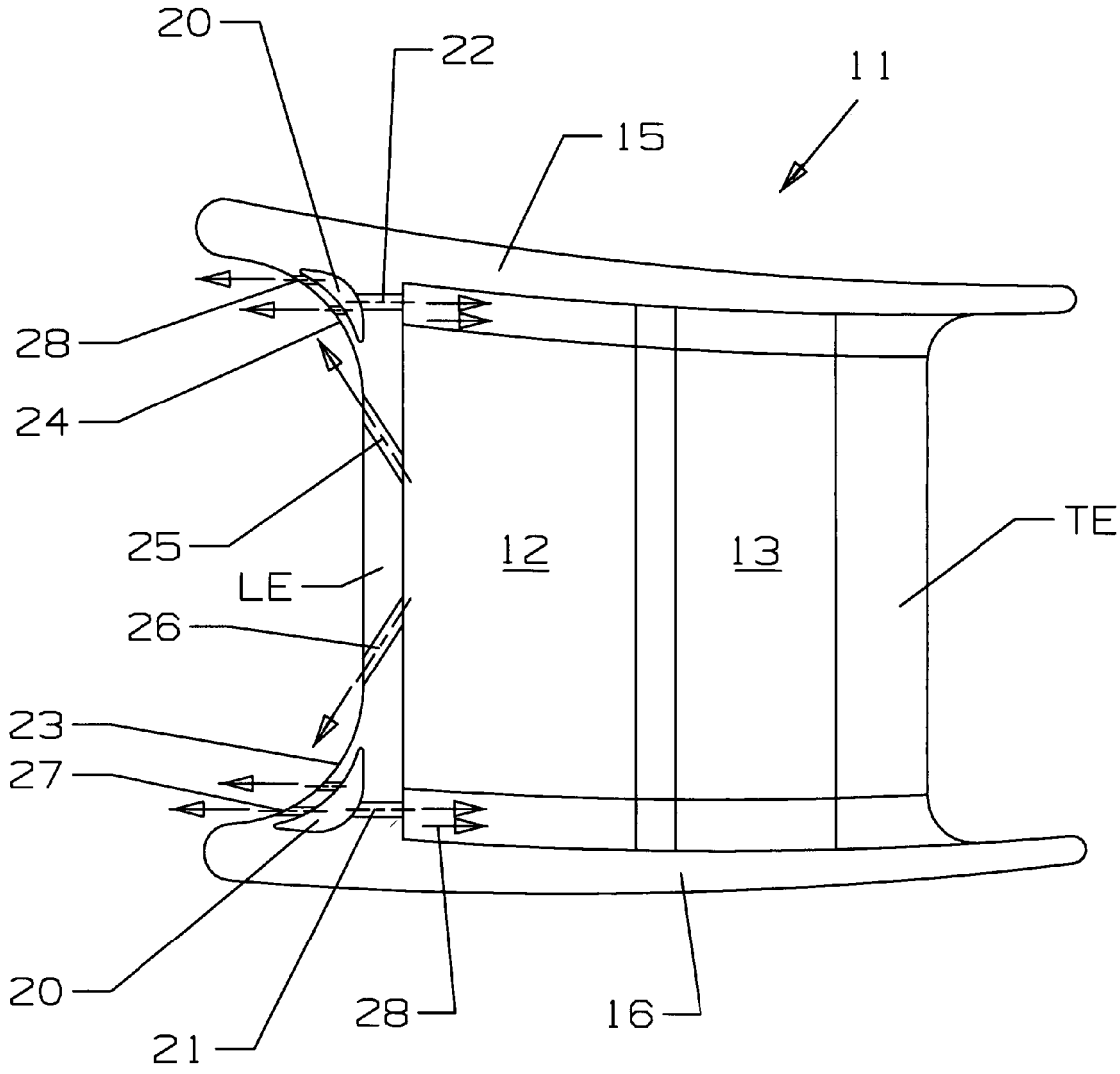
FIG. 6 shows a side view of the fillet cooling arrangement for a turbine vane according to the present invention.
Figure 7:
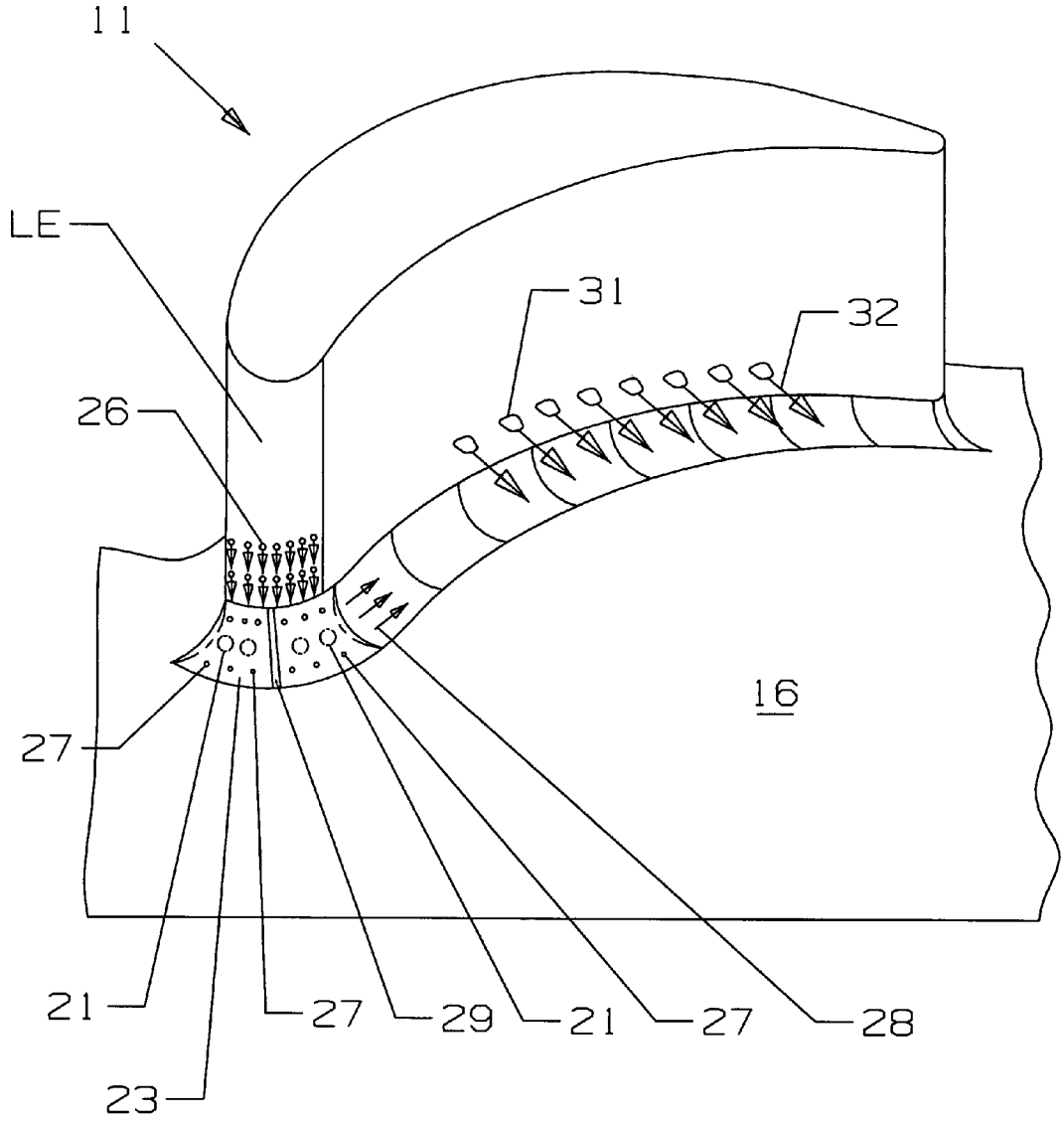
FIG. 7 shows a perspective view of the leading edge fillet cooling arrangement of the present invention.

FIG. 7 shows a perspective view of the lower fillet cooling circuit of the present invention. The louvers form slots on the downstream ends that open onto the fillets extending along the sides of the airfoil wall and endwalls. The cooling air exiting these slots is shown as numeral 28 in FIGS. 6 and 7. An internal partition 29 supports the louvers. Film cooling holes 31 provide film cooling air 32 for the fillet extending along the pressure side of the airfoil downstream from the louver exit slot 28.

Figure 8:
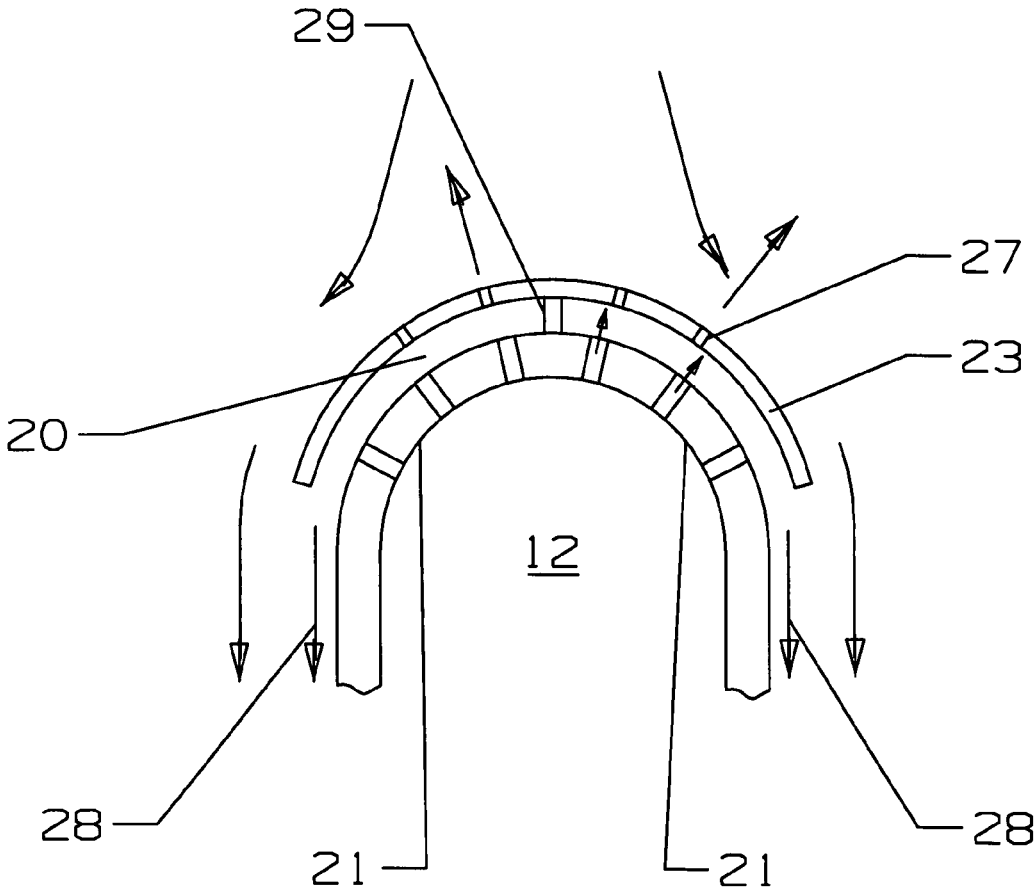
FIG. 8 shows a detailed view of a cross section top view of the leading edge fillet cooling circuit of the present invention.

FIG. 8 shows a detailed cross section view of the lower leading edge fillet cooling circuit. The leading edge impingement cavity 20 is shown formed between the normal fillets of the airfoil wall with the backside impingement cooling hole 21 connected to the internal cooling cavity 12. The louver 23 includes the leading edge fillet cooling holes 27 and the film exit louver cooling slots 28, one on the pressure side of the fillet and another on the suction side of the fillet.

The louver style film cooling slot is formed around the airfoil leading edge and end wall junction region. The louver is built on top of the regular airfoil leading edge fillet. It is preferably cast along with the vane and the cooling cavities and hole. In this particular construction, it retains the original design load path for the airfoil. a partition 29 is used to divide the impingement cavity 20 into separate compartments and form two louver film cooling slots to minimize the pressure gradient effect on film cooling flow distribution.

Cooling air is injected into the louver film slot 28 from the airfoil leading edge cooling supply cavity 12 through a row of metering holes 21. The cooling air is then impinged onto the backside of the louver wall 23 to provide backside impingement cooling for the leading edge fillet. The impingement cooling air is then diffused within the louver film cooling slot prior to discharging into the hot gas flow path. The spent cooling air will flow in the stream-wise direction and provide a film cooling layer for the fillet region immediately downstream of the airfoil leading edge. Other than film cooling slots for the cooling of the airfoil leading edge fillet region, multi-rows of film cooling holes 26, pointed at end wall directions, is installed around the airfoil leading edge peripheral which inject the film cooling air to form a film sub-layer for baffle the louver film cooling slot from the downward draft of the hot core gas stream. Multiple film holes point downward can also be used on the louver top surface to provide film cooling for the louver as well as downstream horseshoe vortex region on the end wall.

Several advantages are exist of the leading edge fillet cooling louvers of the present invention. the louver film slot cooling design provides improved cooling along the horseshoe vortex region and improved film formation relative to the prior art discrete film cooling hole injection method. Film cooling holes on the root of the airfoil leading edge provides convective and film cooling for the airfoil leading edge as well as to baffle the down draft hot gas core air for the leading edge louver slot. The ejected film cooling air is then migrated down the airfoil end wall and provides film cooling for the horseshoe vortex region on the end wall. The backside impingement cooling air provides backside impingement cooling for the louver and diffused within the cooling slot. This creates a better film cooling when it is discharged from the slot on both sides of the airfoil leading edge louvers. This builds up a good film cooling layer for the airfoil fillet region through a large film coverage exit film slot to provide a uniform film cooling for the downstream of the leading edge fillet. Louver film cooling slot increases the uniformity of the film cooling and insulates the leading edge fillet structure from the passing hot core gas, and thus establishes a durable film cooling for the downstream fillet to cool airfoil leading edge fillet. The louver style slot injects cooling air in line with the mainstream flow, minimizing cooling loses or degradation of the film and therefore provides a more effective film cooling for film development and maintenance. The louver style slot extends the cooling air continuously along the interface of the airfoil leading edge versus end wall location, and thus minimizes thermally induced stress by eliminating the discrete cooling hole which is separated by the non-cooled area characteristic of the prior art cooling designs. The louver film cooling slots provide local film cooling all around the leading edge fillet location and therefore greatly reduce the local metal temperature and improve the airfoil life cycle fatigue (LCF) capability.

I claim the following:

1. A turbine airfoil comprising:

an airfoil portion with a leading edge, a pressure side wall and a suction side wall; a endwall extending around the airfoil and having a fillet formed between the airfoil walls and the leading edge and the endwall; an outer fillet surface spaced from an inner fillet surface on the airfoil leading edge and forming a fillet impingement cavity; and, a metering and impingement hole connecting a cooling air supply cavity within the airfoil to the fillet impingement cavity to provide backside cooling of the outer fillet surface exposed to a hot gas flow around the airfoil.

2. The turbine airfoil of claim 1, and further comprising: the outer fillet surface extends around the pressure side wall to form a first slot to discharge the cooling air in a direction substantially aligned with the fillet extending along the pressure side wall.

3. The turbine airfoil of claim 2, and further comprising: the outer fillet surface includes a plurality of film cooling holes to discharge film cooling air.

4. The turbine airfoil of claim 2, and further comprising: the outer fillet surface also extends around the suction side wall to form a second slot to discharge the cooling air in a direction substantially aligned with the fillet extending along the suction side wall.

5. The turbine airfoil of claim 4, and further comprising: a partition within the fillet impingement cavity to separate the pressure side fillet cavity from the suction side fillet cavity; at least one metering and impingement hole opening into the pressure side fillet cavity to provide backside cooling for the pressure side outer fillet surface; and, at least one metering and impingement hole opening into the suction side fillet cavity to provide backside cooling for the suction side outer fillet surface.

6. The turbine airfoil of claim 5, and further comprising: a plurality of film cooling holes in the pressure side outer fillet surface; and, a plurality of film cooling holes in the suction side outer fillet surface.

7. The turbine airfoil of claim 1, and further comprising: the outer fillet surface includes a plurality of film cooling holes to discharge film cooling air.

8. The turbine airfoil of claim 7, and further comprising: the metering and impingement hole is not aligned with the outer fillet surface film cooling holes in order that impingement cooling occurs within the fillet impingement cavity.

9. The turbine airfoil of claim 1, and further comprising: a film cooling hole in the leading edge of the airfoil and directed to discharge film cooling air from a cooling air supply cavity in the direction of the outer fillet surface.

10. The turbine airfoil of claim 1, and further comprising: the airfoil includes an upper endwall with an upper outer fillet surface and a lower endwall with a lower outer fillet surface; and, each outer fillet surface forming a fillet impingement cavity with at least one metering and impingement hole to provide backside cooling of the outer fillet surface.

11. The turbine airfoil of claim 10, and further comprising: the upper and lower outer fillet surfaces each have a plurality of film cooling holes to discharge cooling air from the fillet cavity.

12. The turbine airfoil of claim 10, and further comprising: the upper and lower outer fillet surfaces from slots on the downstream ends of the pressure side and the suction side to discharge cooling air from the fillet impingement cavity along the fillets formed between the airfoil walls and the endwall.

13. The turbine airfoil of claim 12, and further comprising: a partition within the fillet impingement cavities of the upper and the lower fillets to separate the pressure side fillet cavity from the suction side fillet cavity.

14. The turbine airfoil of claim 10, and further comprising: a plurality of upper leading edge film cooling holes to discharge cooling air toward the upper outer fillet surface; and, a plurality of lower leading edge film cooling holes to discharge cooling air toward the lower outer fillet surface.

15. The turbine airfoil of claim 1, and further comprising: the outer and the inner fillet surfaces are cast into the airfoil as a single piece.

16. The turbine airfoil of claim 1, and further comprising: the outer fillet surface extends around the leading edge fillet and stops at about the junction between the leading edge fillet and the airfoil wall fillet.

* * * * *